US009446774B2

(12) United States Patent
Wike

(10) Patent No.: US 9,446,774 B2
(45) Date of Patent: Sep. 20, 2016

(54) RAILWAY CAR TRUCK WITH FRICTION DAMPING

(71) Applicant: Amsted Rail Company, Inc., Chicago, IL (US)

(72) Inventor: Paul Steven Wike, Saint Louis, MO (US)

(73) Assignee: Amsted Rail Company, Inc., Chicago, IL (US)

( * ) Notice: Subject to any disclaimer, the term of this patent is extended or adjusted under 35 U.S.C. 154(b) by 193 days.

(21) Appl. No.: 14/474,889

(22) Filed: Sep. 2, 2014

(65) Prior Publication Data

US 2016/0059870 A1 Mar. 3, 2016

(51) Int. Cl.
*B61F 5/12* (2006.01)

(52) U.S. Cl.
CPC ..... *B61F 5/122* (2013.01)

(58) Field of Classification Search
CPC ..... B61F 5/122; B61F 5/12; B61F 5/04
USPC ..... 105/198.4, 198.2, 207, 198.5, 225, 193; 267/205
See application file for complete search history.

(56) References Cited

U.S. PATENT DOCUMENTS 7,631,603 B2 * 12/2009 Forbes ..... B61F 5/32 105/157.1

* cited by examiner

*Primary Examiner* — Mark Le
(74) *Attorney, Agent, or Firm* — Edward J. Brosius

(57) ABSTRACT

A three piece railway freight truck is comprised of two laterally spaced side frames between which a bolster extends. Suspension load springs support the bolster, and control springs support friction shoes. Both variations of friction shoes have gaps that will allow lateral movement of the friction shoes across the bolster or the friction shoes across the side frame. The lateral movement is accomplished by having a low friction material pad between the bolster and the friction shoe or a low friction material pad between the friction shoe and a wear plate that bears on the side frame. The low friction material with low siding resistance allows lateral displacement energy to be dissipated over the lateral decoupling clearance.

8 Claims, 8 Drawing Sheets

RAILWAY CAR TRUCK WITH FRICTION DAMPING

BACKGROUND OF THE INVENTION

The traditional three piece railway freight car truck consists of one bolster and two side frames. The side frames are supported at their ends by the wheelsets. The bolster which carries the car body extends centrally through the side frames. The bolster is supported on suspension springs with damping friction shoes located in the side frames that support the bolster. The suspension contains load springs that support the bolster and control springs that support the friction shoes. The friction shoes include angled surfaces that bear against the bolster in pockets that have mating angled surfaces. The result of the spring three acting on friction shoe against the angled support of the bolster is a wedge force acting on the side frame. Damping is the result of the wedge force on the friction shoe flat surface sliding against and along the flat surface of the side frame. The resulting wedge force and friction between the friction shoe flat surface and the side frame flat surface creates sliding force resistance to movement. The friction shoe sliding force resistance increases as the springs are compressed. The friction shoe sliding force resistance is primarily intended for vertical damping; however the friction shoe sliding force resistance is also coupled to lateral movement.

The traditional three piece railway freight truck speed is limited due to lateral track displacement irregularities that initiate uneven steering force at the wheels. The uneven steering force accompanied by the truck and car body inertias cause the trucks to steer or yaw. The instability process repeats itself describing a sinusoidal path that increases with speed of the freight car. The instability is called hunting and is inherent to the tapered wheel tread surface design as used in a traditional three piece railway freight truck. Lateral track displacement irregularities transmitted to the wheelsets and into the side frames create lateral displacement of the side frames. The lateral displacement of the side frames is transmitted through the friction shoes and into the bolster and finally from the bolster into the car body. The lateral displacement provides the energy necessary to displace the car body. The displacement energy then rebounds with sufficient inertia to return the car body back through the neutral position. The displacement energy inertia continues back through the truck, and through the wheelsets. Each pair of tapered wheels is rigidly connected by an axle. The rigidly connected wheels and axle are referred to as a wheelset. Lateral displacement between the wheelset to the track position creates difference in the rolling radius of the tapered wheels. The rolling radius change creates a difference in the distance each wheel travels along the rails, which yaw the wheelset and attempts to turn the truck. This leads to instability of the truck on the rails and excess wheel wear.

The present invention relates to decoupling the displacement energy path from the wheelset to the car body and the car body rebound energy back to the wheelsets. Laterally decoupling the ability of friction shoes to transmit displacement energy to or from the wheelsets or the car body prevents displacement energy from displacing the wheelsets in relation to the track. This in turn prevents wheelset yaw and the sinusoidal path of the freight car truck as it travels along the rails.

SUMMARY OF THE INVENTION

The traditional three piece railway freight car truck speed is limited due to the instability of the truck which describes a sinusoidal path down the track that grows with speed. The instability is called hunting and is inherit to the tapered wheel tread design of the traditional three piece railway freight car truck. Lateral track displacement irregularities that are transmitted to the wheelsets, through the side frames and friction shoes and into the bolster and finally from the bolster into the car body. The car body rebounds with sufficient displacement energy inertia back through the truck, and through the wheelsets. The lateral displacement between the wheelset in relation to track position creates difference in the rolling radius of the tapered wheels changing the distance the wheels travel along the rails, which yaws the wheelset and turns the truck.

The present invention relates to decoupling the displacement energy path from wheelset to the car body and the car body rebound energy back to the wheelsets. Laterally decoupling the ability of friction shoes to transmit displacement energy to or from the wheelsets or the car body, prevents displacement energy from displacing the wheelsets to the track and in turn prevents the wheelset yaw and the sinusoidal path of the truck as it travels along the rails.

DETAILED DESCRIPTION OF THE INVENTION

Figure 1:
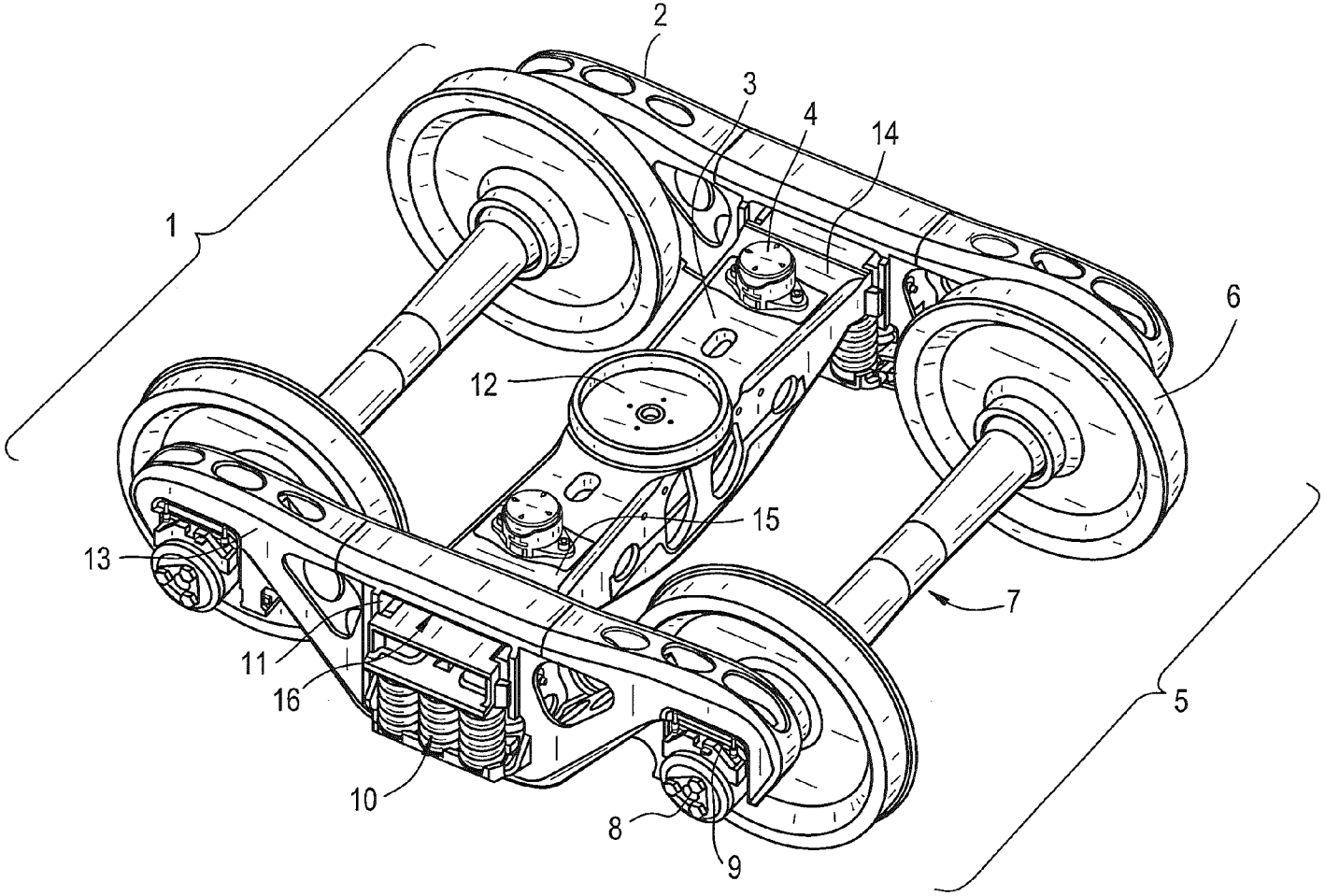
FIG. 1 is a perspective view of a three piece railway freight truck assembly of a applicable to all embodiments of the present invention.
Figure 7:
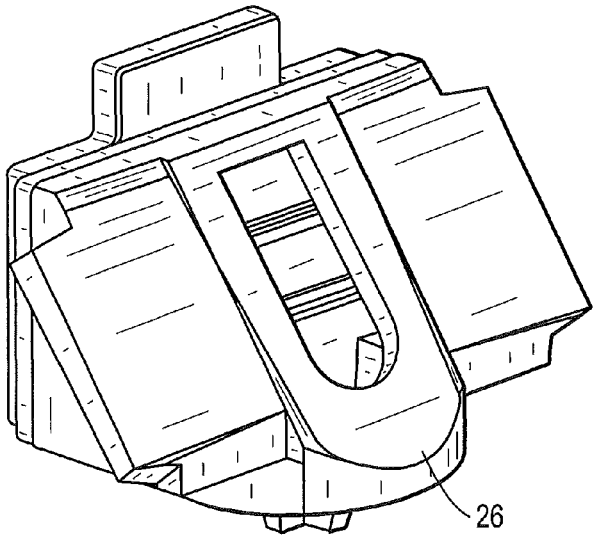
FIG. 7 is a view of a friction shoe and low friction material in accordance with a third embodiment of the present invention.

Referring now to FIG. 1, is a perspective view of a three piece railway freight car truck assembly 1 is seen to be comprised of two laterally spaced side frames 2 and 13 between which bolster 3 extends. Bolster 3 is seen to include bolster ends 14 and 15, which extend through side frame openings 16. Suspension springs 10, is seen to support bolster end 15 as well as, variants for lateral decoupling friction shoes 11, it should be understood that railway freight car truck assembly 1 as shown in FIG. 1 may also be arranged to accommodate friction shoe 11 or, with the introduction of recess 21 on bolster slope surface as shown in FIG. 4, also accommodate friction shoe 19. The first variant is lateral decoupling between the bolster 3 and friction shoes 11 or 19, seen in FIGS. 3 and 4. Friction shoes 11 or 19 differ in the friction constant of the low friction material pad 17 or pad 20, and the recess in which the respective pads are received. The second variant is lateral decoupling between friction shoe 26 as seen in FIG. 7 and side frames 2 and 13. Friction shoes 11, or 19, or 26 provide vertical damping in the form of sliding resistance between the side frames 2 and 13 and bolster 3. The friction shoes 11, or 19, or 26 have a decoupling mechanism that provides lateral damping in the form of sliding resistance to movement between the side frames 2 and 13 and bolster 3. Bolster 3 is seen to include on its upper surface a bolster center bowl 12, and a pair of laterally spaced side bearings 4. Wheelset 5 consists of two wheels 6 pressed on axle 7. The wheelset 5 has bearings 8 mounted at both ends of axle 7. The wheelset 5 bearings 8 support the side frames 2 and 13 on bearing adapters 9.

Side frames 2 and 13 and bolster 3 are usually comprised of a single cast steel structure. Axle 7 is usually comprised of a forged steel unitary structure. Wheels 6 are usually unitary cast steel structures.

Figure 2:
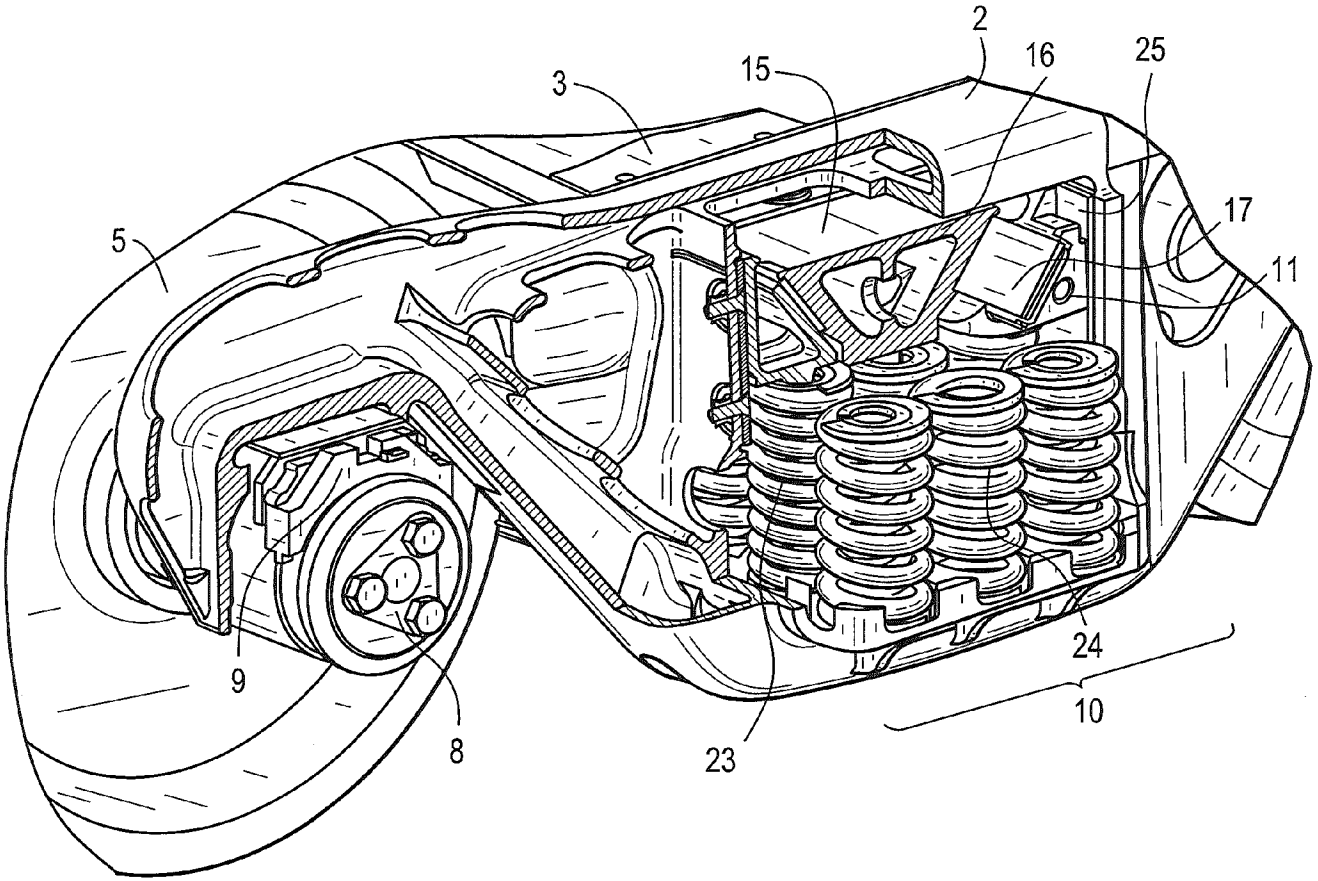
FIG. 2 is a partial detailed cut away view of a traditional three piece railway freight truck of a first embodiment of the present invention.

Referring now to FIG. 2, a partial detailed cut away view of a three piece railway freight car truck assembly 1 is shown along with detailed views of bolster 3 and side frame 2 in partial cross section. Bolster end 15 extends through side frame opening 16 and is supported by suspension springs 10 which themselves are supported on a spring support section of side-frame 2. Suspension springs 10 consist of load springs 24 which support bolster 3. Suspension springs 10 also include control springs 23 that support friction shoes 11 or 19 that bear against a low friction material pad 17 or 20 which angularly bears against a complementary sloped surface of bolster 3. Damping is the result of the wedge force on friction shoe 11 or 19 flat surface sliding against and along vertical wear plate 25 of side frame 2.

Figure 3:
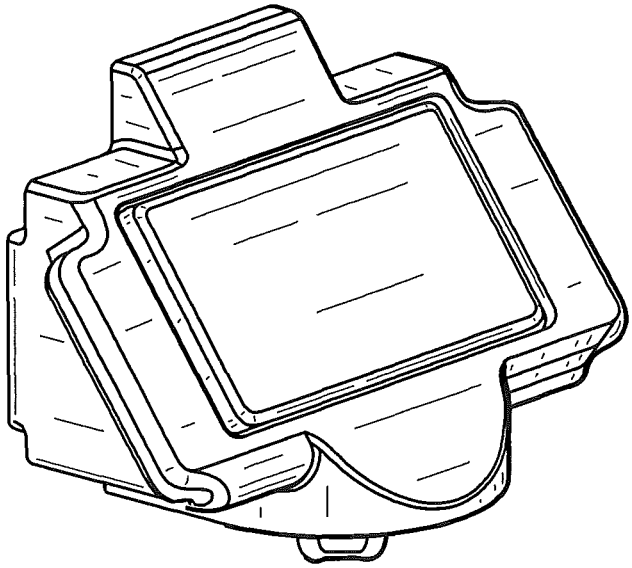
FIG. 3 is a view of a friction shoe with a low friction material insert; of a first embodiment of the present invention.
Figure 3A:
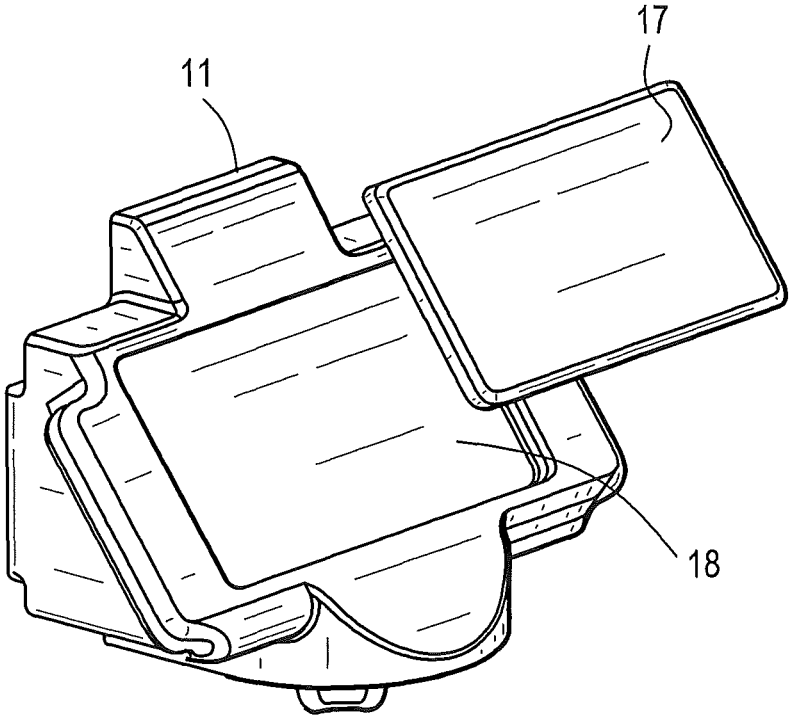
FIG. 3A is an exploded view of a friction shoe and low friction material of a first embodiment of the present invention.
Figure 4:
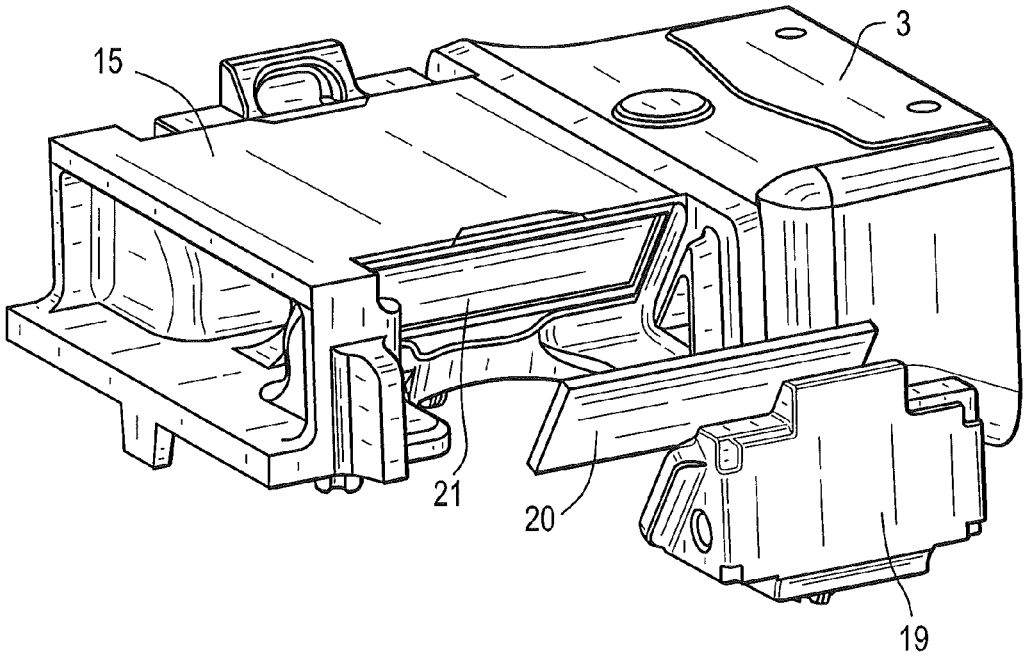
FIG. 4 is a partial view of the railway truck bolster end and an exploded view of a friction shoe of a second embodiment of the present invention.

Referring now to FIGS. 3 and 3A, an exploded view of a friction shoe 11 and low friction material 17 of a three piece railway freight car truck is shown. Friction shoe 11 is typically comprised of cast steel or iron that has been heat treated to a brinell hardness of about 500 to prevent material loss due to adjacent surfaces rubbing against each other. Friction shoe 11 on its slope surface has a recess 18 of a complementary depth and shape to hold the low friction material pad 17. Low friction material pad 17 preferably is a phenolic instilled with linen and graphite or a polymer infused with glass fiber and graphite a typical static coefficient of friction for pad 17 is 0.2 to 0.5, with a running coefficient of friction of 0.01 to 0.2.

Referring now to FIGS. 4 and 4A, a view of the bolster end 15 and friction shoe 19 of a three piece railway freight truck. Bolster 3 is shown with recess 21 in bolster end 15. Recess 21 is of complementary depth and shape to hold low friction material pad 20. Low friction material pad 20 preferably is comprised of a phenolic infused with linen and graphite or a polymer infused with glass fiber and graphite. Friction shoe 19 is typically comprised of cast steel or iron that has been heat treated to a brinell hardness of about 500 to prevent material loss due to adjacent surfaces rubbing against each other. Typical static coefficient of friction for pad 20 is 0.2 to 0.5, with a running coefficient of friction of 0.01 to 0.2.

Figure 5:
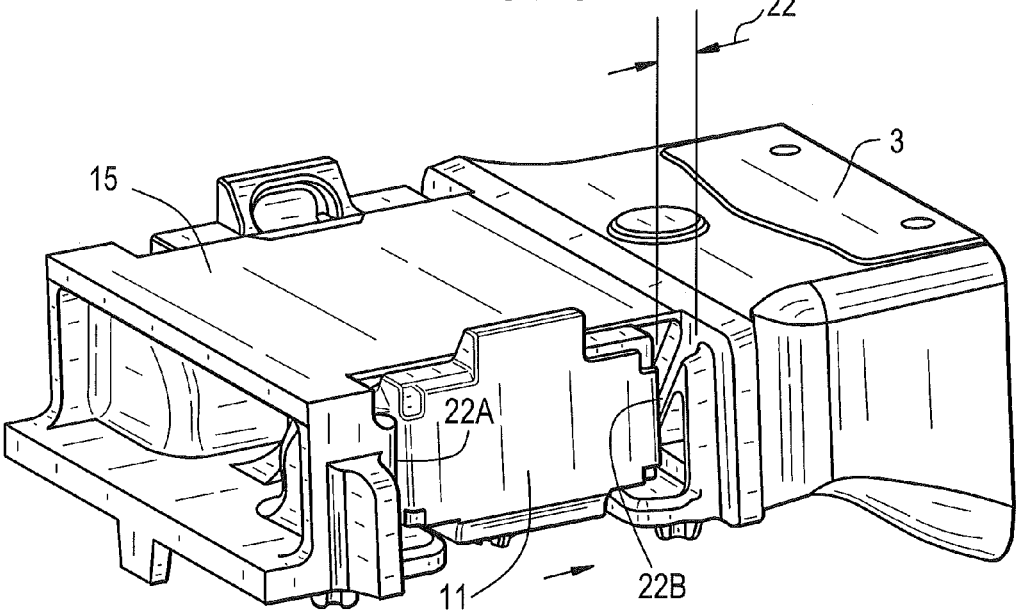
FIG. 5 is a partial view of the bolster end and friction shoe lateral decoupling spacing applicable to all embodiments of the present invention.
Figure 5A:
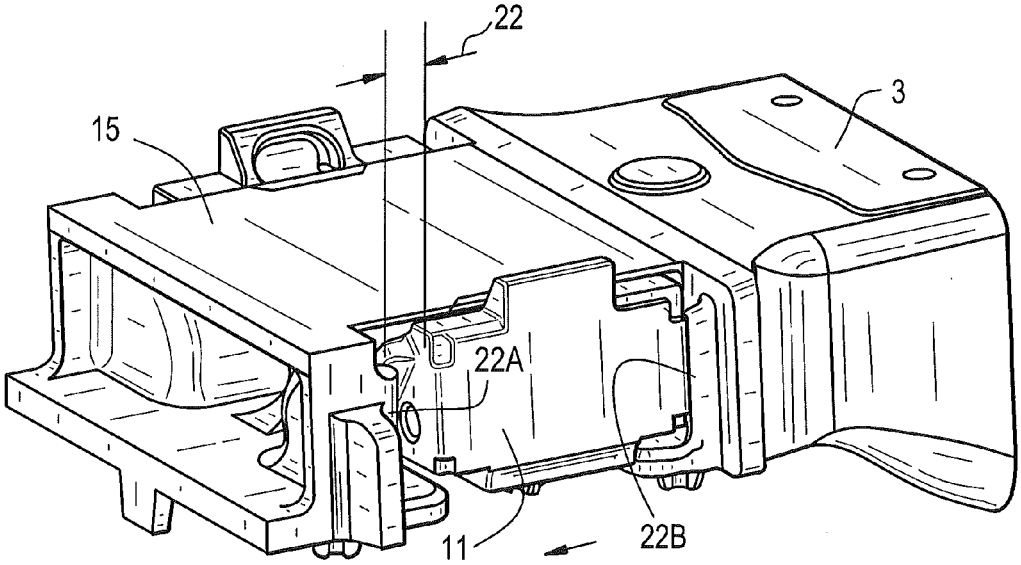
FIG. 5A is a partial view of the bolster end and friction shoe lateral decoupling spacing applicable to all embodiments of the present invention.

Referring now to FIG. 5, a view of the bolster end 15 and friction shoe 11 lateral decoupling clearance of a three piece railway freight car truck. This arrangement is equally applicable to friction shoe 19 and pad 20. Friction shoes 11 or 19 have gaps 22 from the walls 22A, 22B forming friction shoe pocket in bolster 3, that will allow lateral movement across bolster end 15. The friction shoes 11 or 19 bear upon low friction material pad 17 or 20, which in turn bear on bolster 3. The low friction material pad 17 or 20 low siding resistance allows lateral displacement energy to be dissipated over the lateral decoupling clearance. By laterally decoupling the ability of friction shoes to transmit displacement energy to or from the wheelsets or the car body, prevents displacement energy from displacing the wheelsets to the track which in turn prevents wheelset yaw and the sinusoidal path of the freight car assembly 1 truck as it travels along the rails. The preferred dimension of GAP 22 is 0.3 to 0.5 inch (0.76 to 1.27 cm).

Figure 6:
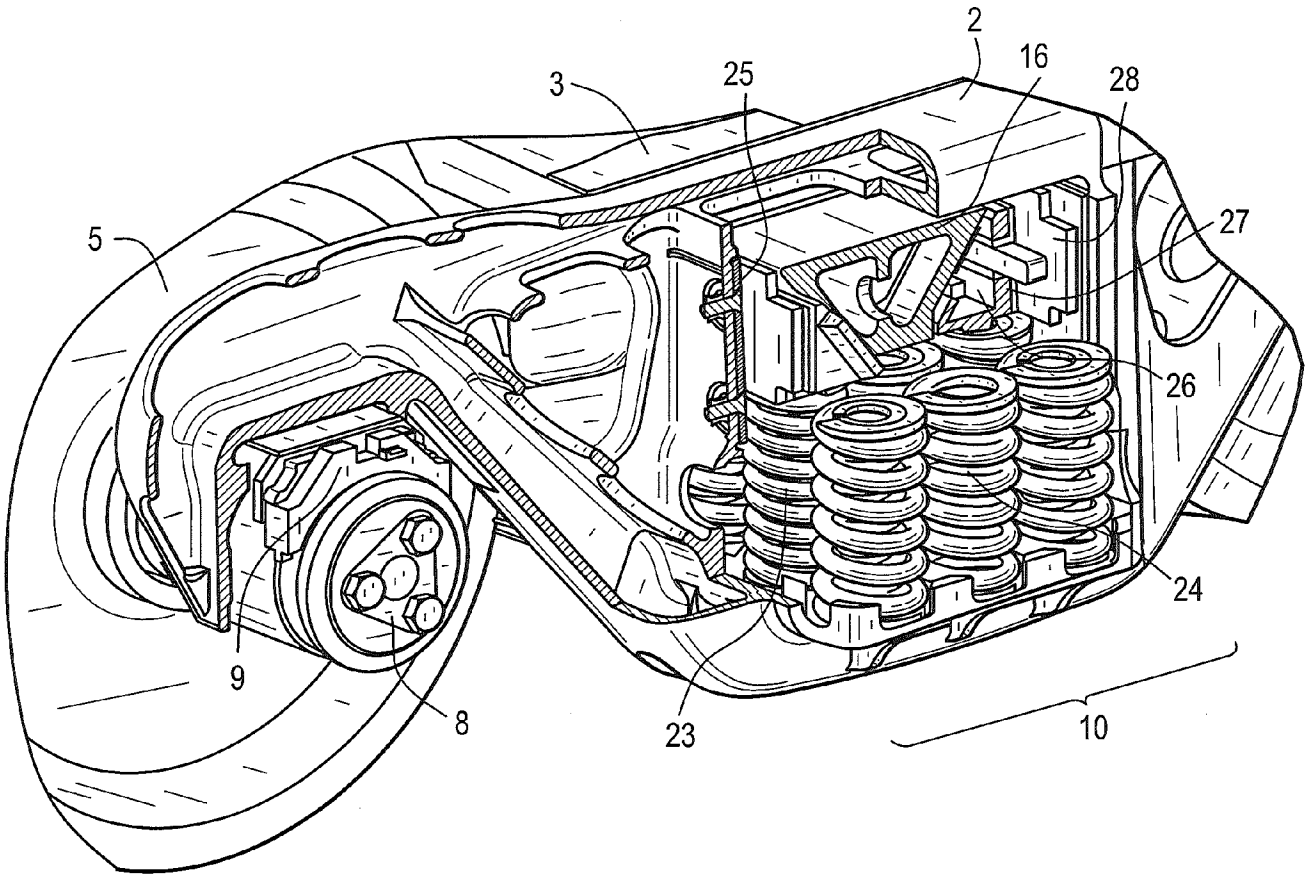
FIG. 6 is a partial detailed cut away view of a three piece railway freight truck with a third embodiment of the present invention.

Referring now to FIG. 6, a partial detailed cut away view of a three piece railway freight car truck assembly 1 is shown along with detailed partial views of bolster 3 and side frame 2 in partial cross section. Bolster end 15 extends through side frame opening 16; bolster end 15 is supported by suspension springs 10. Suspension springs 10 consist of load springs 24 which support bolster end 15 and thusly bolster 3. Also included are control springs 23 that support friction shoes 26 that angularly bear against the bolster 3. Friction shoe 26 flat surface has a low friction material pad 27 between it and wear face 28. Damping pad results from the wedge force on friction shoe 26 flat surface through low friction material pad 27 and wear face 28 sliding against wear plate 25 of side frame 2.

Figure 7A:
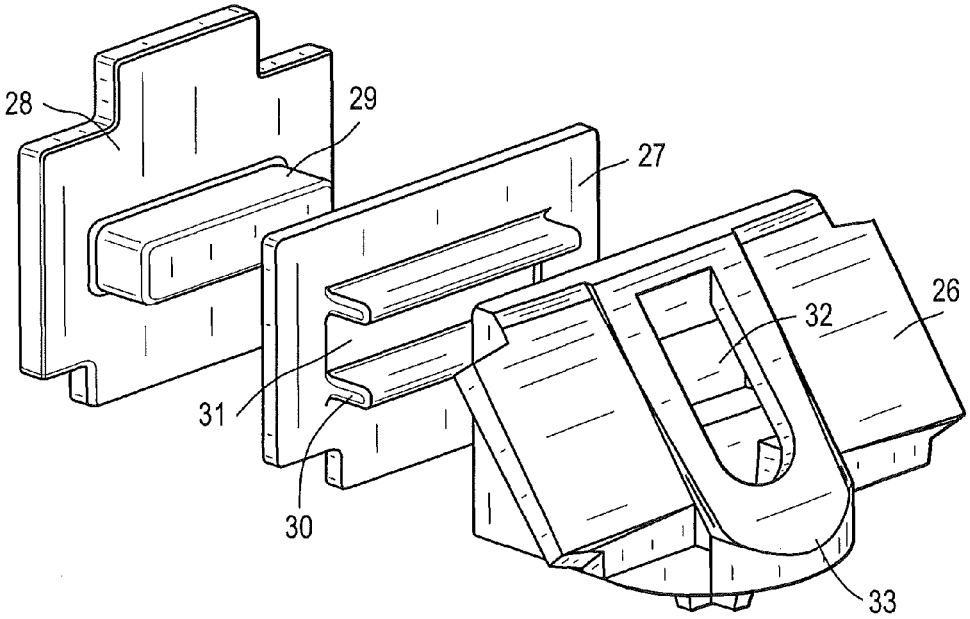
FIG. 7A is an exploded view of a friction shoe and low friction material as well as a view of the wedge lateral decoupling spacing of the friction shoe of a third embodiment of the present invention.

Referring now to FIGS. 7 and 7A, a perspective view and exploded view of a friction shoe 26 of a three piece railway freight truck are shown. Friction shoe 26 consists of low friction material pad 27 and wear plate 28. Friction shoe 26 is typically comprised of cast steel or iron. The low friction material pad 27 preferably is comprised of a phenolic infused with linen and graphite or a polymer infused with glass fiber and graphite. Wear plate 28 is typically comprised of steel or iron that has been heat treated to a brinell hardness of about 500 to prevent material loss due to adjacent surfaces rubbing against each other. Wear plate 28 has a raised bar 29 that is constrained vertically and laterally between the low friction material pad 27 complementary extensions 30 and 30A. Low friction material pad 27 is formed with opening 31 between extensions 30 and 30A of and low friction material pad 27. In turn, extensions 30 and 30A on the top and bottom insert into opening 32 on friction shoe 26. Low friction material pad extensions 30 and 30A serve as guides for the lateral movement of wear plate 28 with raised bar 29.

Figure 8:
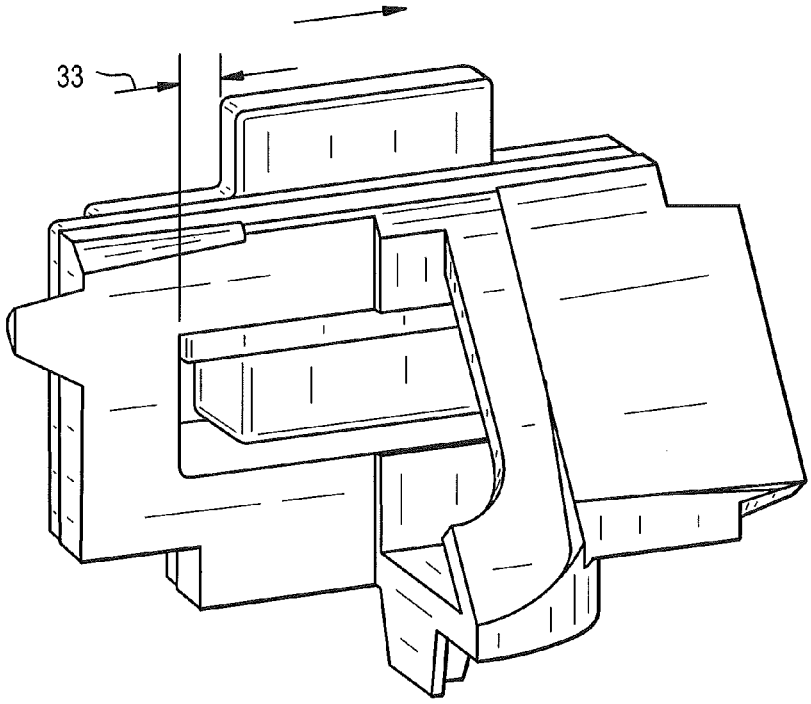
FIG. 8 is a perspective cut away view of friction shoe lateral decoupling clearance of a three piece railway freight truck of a third embodiment of the present invention.
Figure 8A:
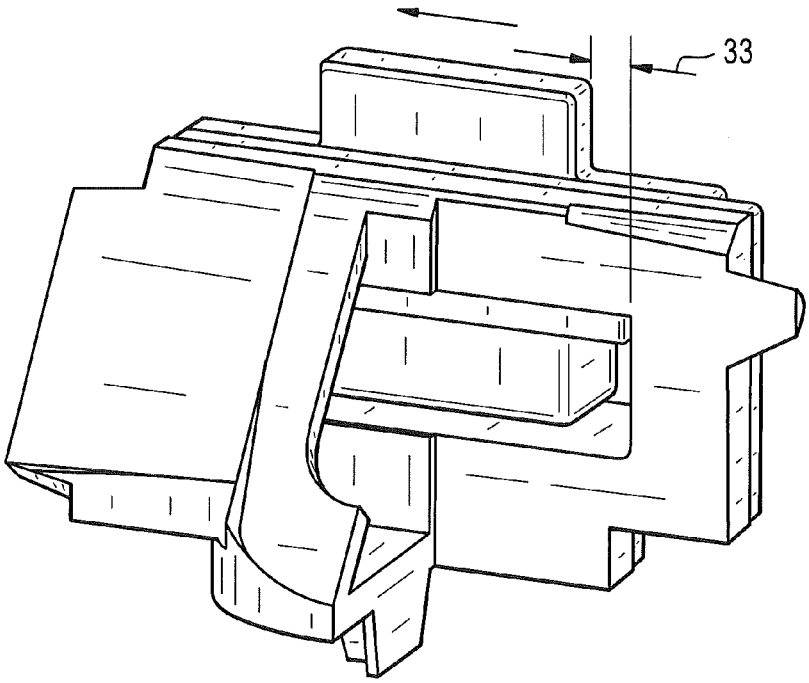
FIG. 8A is a perspective cut away view of friction shoe lateral decoupling clearance of a three piece railway freight truck of a third embodiment of the present invention.

Referring now to FIG. 8, a perspective cut away view of friction shoe 26 with lateral decoupling clearance of a three piece railway freight truck is shown. Friction shoe 26 has gaps 33 that allows lateral movement of wear plate 28 across friction shoe 26. Wear plate 28 bears upon low friction material pad 27, which in turn bears on friction shoe 26. The low sliding resistance of low friction material pad 27 allows lateral displacement energy to be dissipated over the lateral decoupling clearance. The laterally decoupling the ability of friction shoes to transmit displacement energy to or from the wheelsets or the car body, prevents displacement energy from displacing the wheelsets to the track which in turn prevents the wheelset yaw and the sinusoidal path of the truck as it travels along the rails.

What is claimed is:

1. A railway freight car truck comprising:

two sideframes, each having a spring support base, bolster support springs on the sideframe spring support base, a bolster extending traverse to the two sideframes, the bolster having two end sections, each bolster end section extending into and being supported on one of the spring support bases by the support springs, each sideframe including a bolster opening formed by two sideframe vertical sidewalls, each bolster end section including two sloped surfaces each forming a bolster end pocket, a friction shoe having a sloped face and a vertical face, the sloped face of the friction shoe including a recess, a first low friction material pad of a shape complementary to and received in the recess in the sloped face of the friction shoe, and wherein the first low friction material pad is of a height that extends outward from the recess in the sloped face of the friction shoe, the friction shoe located in the bolster end pocket such that the first low friction material pad is located adjacent the bolster end sloped surface, and the friction shoe vertical face is located adjacent the sideframe vertical sidewall, wherein the friction shoe further comprises a wear plate having a bar extending therefrom, a second low friction material pad having an opening formed by two protrusions adjacent to receive the wear plate bar, and a reception opening in the friction shoe vertical face wherein the two protrusions from the second low friction material pad are received.

2. The railway freight car truck of claim 1 further comprising:

the wear plate having a front face and a rear face, and wherein the wear plate bar extends transverse from the wear plate rear face, and wherein the second low friction material pad has a front face and a rear face, and wherein the two protrusions extend transverse from the second low friction material pad rear face.

3. The railway freight car truck of claim 1 wherein the reception opening in the friction shoe vertical face in a horizontal dimension is about equal to the two protrusions in a horizontal dimensions.

4. The railway freight car truck of claim 1 wherein the bar extending from the wear plate in a horizontal dimension is smaller than the reception opening in friction shoe vertical face in a horizontal dimension.

5. A railway freight car truck comprising:

two sideframes, each having a spring support base, bolster support springs received on the sideframe spring support base, a bolster extending traverse to the two sideframes, the bolster having two end sections, each bolster end section extending into and being supported on one of the spring support bases by the support springs, each sideframe including a bolster opening formed by two sideframe vertical sidewalls, each bolster end section including two sloped surfaces each forming a bolster end pocket, a friction shoe having a sloped face and a vertical face, the sloped face of the friction shoe including a recess, a first low friction material pad of a shape complimentary complementary to and received in the recess in the sloped face of the friction shoe, and wherein the first low friction material pad is of a height that extends outward from the recess in the sloped face of the friction shoe, the friction shoe located in the bolster end pocket such that the first low friction material pad is located adjacent the bolster end sloped surface, and the friction shoe vertical face is located adjacent the sideframe vertical sidewall, a wear plate having a bar extending therefrom, a second low friction material pad having an opening formed by two protrusions adjacent to receive the wear plate bar, and a reception opening in the friction shoe vertical face wherein the two protrusions from the second low friction material pad are received.

6. The railway freight car truck of claim 5 further comprising:

the wear plate having a front face and a rear face, and wherein the wear plate bar extends transverse from the wear plate rear face, and wherein the second low friction material pad has a front face and a rear face, and wherein the two protrusions extend transverse from the second low friction material pad rear face.

7. The railway freight car truck of claim 5 wherein the reception facing in the friction shoe material face in a horizontal dimension is about equal in length to the two protrusions in a horizontal dimension.

8. The railway freight car truck of claim 5 wherein the bar extending from the wear plate in a horizontal dimension is smaller than the reception opening in the friction shoe vertical face in a horizontal dimension.

* * * * *